United States Patent [19]

Ishimoto

[11] Patent Number: 4,471,566

[45] Date of Patent: Sep. 18, 1984

[54] DIRECTION CONVERTING DEVICE FOR A RUNNING CAR RACER

[75] Inventor: Zenichi Ishimoto, Tokyo, Japan

[73] Assignee: Nikko Co., Ltd., Tokyo, Japan

[21] Appl. No.: 337,500

[22] Filed: Jan. 6, 1982

[30] Foreign Application Priority Data

Sep. 19, 1981 [JP] Japan ..... 56-148269

[51] Int. Cl.[3] ..... A63H 33/26

[52] U.S. Cl. ..... 446/129; 446/456; 446/460

[58] Field of Search ..... 46/235, 234, 262, 254, 46/253; 273/86 B

[56] References Cited

U.S. PATENT DOCUMENTS

| | | | |
|---|---|---|---|
| 1,796,157 | 3/1931 | Moore | 46/253 |
| 1,856,991 | 5/1932 | Franklin | 46/253 X |
| 4,034,504 | 6/1977 | Sudo | 46/254 |
| 4,163,341 | 8/1979 | Jones et al. | 46/262 |
| 4,171,592 | 10/1979 | Saitoh | 46/235 |

FOREIGN PATENT DOCUMENTS

| | | | |
|---|---|---|---|
| 24240 | 2/1981 | European Pat. Off. | 46/262 |
| 2809250 | 9/1978 | Fed. Rep. of Germany | 46/262 |

*Primary Examiner*—Mickey Yu

[57] ABSTRACT

A direction converting device for a toy car has an electromagnet energizable to a desired polarity upon change of a running direction and at least a pair of magnet elements arranged oppositely thereto and maintained at different polarities from each other. The electromagnet or the pair of magnets may be secured to a controlling element swingably in a horizontal plane, while the controlling element is engaged with a steering plate articulatingly connected to wheels.

3 Claims, 4 Drawing Figures

DIRECTION CONVERTING DEVICE FOR A RUNNING CAR RACER

FIELD OF THE INVENTION

This invention relates to a direction converting device for a running car racer by means of a wireless control system.

BACKGROUND OF THE INVENTION

As a direction converting device for the running car racer, there has already been known a device in which a steering plate mounted on front wheels is turned to the left or the right through a worm gear mechanism by reversible operation of a servo-motor for converting the direction of the front wheels to the straight, the right or the left.

In the conventional direction converting device, however, frequent changes in direction of the car racer may require the corresponding frequent reversal of the servo-motor, thereby generating sparks at various contacts forming the electrical system of the servo-motor. Such sparks in the servo-motor may cause damage to the electrical system of the servo-motor and erroneous operation of the wireless controller. In particular, the servo-motor is disadvantageous in that its cost is high in order to obtain excellent control performance and that it requires more increased cost for designing a control circuit to avoid the sparks.

Now it has been found that combination of an electromagnet capable of retaining a desired polarity through a given instruction with a controlling element spaced apart at a certain distance from the electromagnet and secured at its one end swingably and provided at its other end with magnets each having opposite polarity, in which the controlling element near its center is engaged with a center of a steering plate, may enable the controlling element to turn to any direction through attraction of either one of magnets on the controlling element to the electromagnet depending on its energized state, thereby permitting the steering plate to convert its direction. In this case, the controlling element is preferably kept at its neutral position when the electromagnet is in its deenergized state.

SUMMARY OF THE INVENTION

Accordingly, a general object of the invention is to provide a direction converting device for a running car racer, which is simple in construction and controlling operation, causes less trouble and may be manufactured at a lower cost.

A principal object of the invention is to provide a steering mechanism for a running toy car racer, which comprises an electromagnet energizable as desired to a desired polarity and at least a pair of fixed magnet elements symmetrically arranged on a car body and maintained at different polarities from each other. The electromagnet or the pair of fixed magnet elements being secured to one end of a controlling element arranged swingably in a horizontal plane. The controlling element is engaged with a steering plate connected to wheels.

PREFERRED EMBODIMENTS OF THE INVENTION

In the direction converting device according to the invention, the pair of fixed magnet elements may be comprised of independent magnets separated from each other or of a single magnet of a U shape.

Preferably, the electromagnet is secured on the car body while the pair of magnets are secured to one end of the controlling element, and the controlling element is biased in its neutral position when the electro-magnet is in its deenergized state.

The electromagnet may be comprised of wound double coils each having opposite polarity from the other. In this case, either one or both of the coils of the electromagnet may be energized by means of a wireless control system.

Alternatively, the electromagnet may be comprised of a single coil, wherein the single coil may be energized reversively to an opposite polarity at each time.

Now the invention will be illustrated in more detail hereinbelow on its preferred embodiments with reference to accompanying drawings.

DETAILED DESCRIPTION OF THE INVENTION

Figure 1:
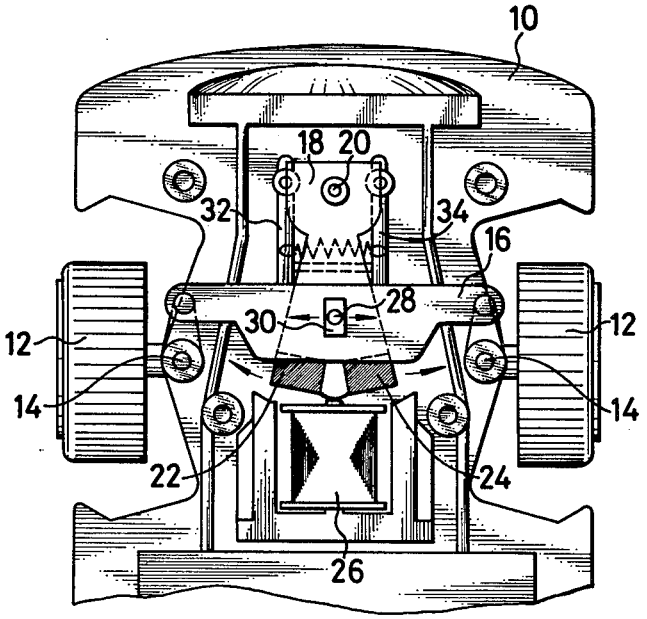
FIG. 1 shows construction of a car body having main parts of the direction converting device according to the invention.

FIG. 1 shows one embodiment of body construction of a car racer having the device according to the invention and operated by a wireless control system. In FIG. 1, the car body includes a front part 10 and wheels 12. A pair of wheels 12, 12 are engaged with a steering plate 16 at each of the ends of the steering plate through rocking shaft bearings 14, 14. In the illustrated embodiment, therefore, movement of the steering plate 16 to the right permits the wheels 12, 12 to turn to the right. Beneath the steering plate 16 is arranged a controlling element 18, which at its one end is swingably secured to a shaft 20 protruded from the base 10 of the car body and at its other end is provided with a pair of magnets 22, 24. Oppositely to the magnets 22, 24 on the controlling element 18 there is arranged an electromagnet 26 secured to the car base 10. Near the center of the controlling element 18 there is provided a protrusion 28, which is opposed to a fitting aperture 30 provided in the steering plate 16, thereby allowing the controlling element 18 to engage swingably in a horizontal plane with the steering plate 16.

In the embodiment described hereinabove, the electromagnet 26 is comprised of double wound coils each being energizable to opposite polarity from the other, while the pair of magnets 22, 24 opposed to the electromagnet 26 have also different polarities from each other. Therefore, if the electro-magnet 26 at its top end is energized to the N polarity, for example, then the controlling element 18 comes to attracting relation to the one magnet 22 and turns to the right around the supporting shaft 20. Similarly, if the electromagnet 26 at its top end is energized to the S polarity, then the controlling element 18 comes to attracting relation to the other magnet 24 and turns to the left around the supporting shaft 20. In this way, the wheels 12, 12 may be controlled for turning to the right or the left through change-over of the energized state of the electromagnet 26 in accordance with this embodiment.

Figure 2:
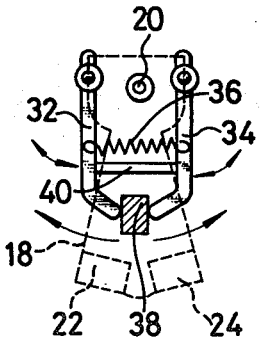
FIG. 2 is a schematic view showing a mechanism for positioning the controlling element of FIG. 1.

In accordance with the invention, the wheels 12, 12 are preferably kept neutral for running straight upon the deenergized state of the electromagnet 26. For this purpose, as shown in FIG. 2, a pair of supporting rods 32, 34 may be arranged symmetrically to the shaft 20 supporting the controlling element 18. The supporting rods 32, 34 at their one ends are pivoted to the car base 10 while at their middle parts are connected elastically with a spring 36, and their swingable ends may be engaged with a stopper 38 protruded from the controlling element 18 biasing keeping the stopper at its predetermined neutral position. In this case the neutral position is established by a positioning element 40 protruded from the car base 10. Thus, even if the controlling element 18 is deviated to the left or the right under influence of the electromagnet 26, it may be restored to its neutral position through the resilient action of spring 36 upon deenergization of the electromagnet 26.

Figure 3:
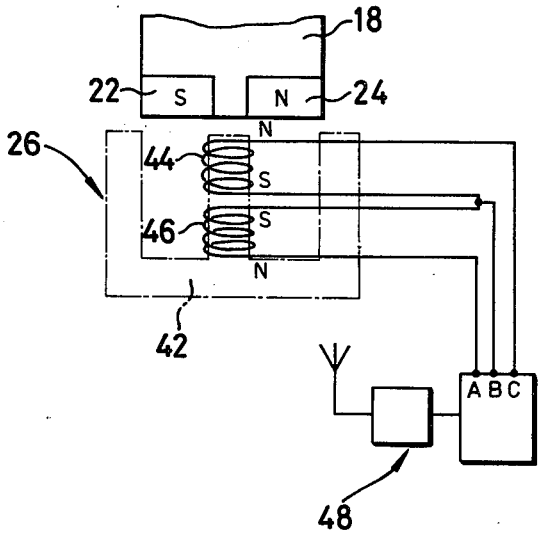
FIG. 3 is a schematic view showing one embodiment of the electromagnet used in the device according to the invention.

FIG. 3 shows the working principle of the double wound coil type of electromagnet 26 used in the device according to the invention. Namely, the electromagnet 26 is comprised of a pair of coils 44, 46 each being wound around an iron core 42 in such a way that electric current may flow in opposite direction to each other. Thus, when one of the coils 44, 46 receives a given instruction signal by a wireless receiver 48, the coil 44 or 46 is connected to an electric power for providing the desired polarity to the controlling element 18 depending on the property of the coil 44 or 46.

Figure 4:
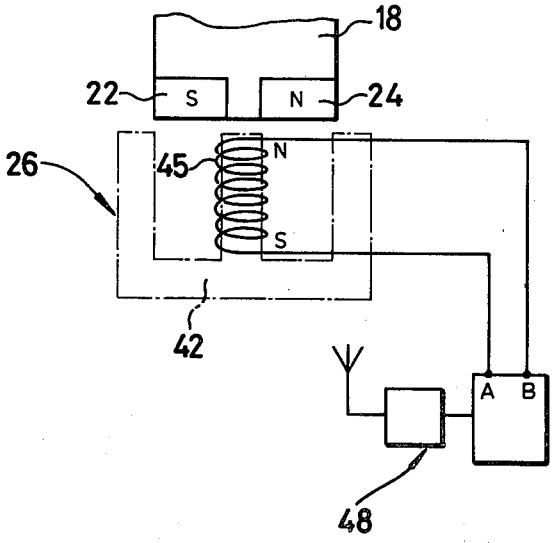
FIG. 4 is a schematic view showing another embodiment of the electromagnet used in the device according to the invention.

In the device according to the invention, as shown in FIG. 4, there may be employed as the electromagnet 26 a single coil 45 wound around an iron core 42, wherein the polarity may be optionally reversed in the single coil 45 by a suitable circuit in the wireless receiver side 48. Thus, similarly to the previous embodiment, the controlling element 18 may be turned to the left or the right and may be restored to its neutral position through the resilient action of the spring 36 immediately after deenergization of the electromagnet 26.

It will be appreciated from the embodiments described hereinbefore, if the direction converting device according to the invention is applied to the running car racer with the wireless control system, two different instruction signals may change the energized state of the electromagnet, thereby readily controlling the turning direction of the wheels.

In the previous embodiments two magnets have been employed for one electromagnet but, of course, a single magnet of a U shape may be selectively employed. Further, arrangement of the electromagnet on the controlling element and fixation of the magnets oppositely thereto may provide a similar effect. More than two magnets may be secured on the controlling element and the magnetic strength of the electromagnet may be made variable for changing radius of a running course.

As described hereinabove, the steering mechanism according to the invention comprises combination of the electromagnet and the magnets, so that it may be simple in construction, very low in manufacturing cost, free of erroneous operation of the wireless controller, and steady and reliable in the direction control.

Although the invention has been described for its preferred embodiments hereinbefore, various changes and modifications may be made without departing from the spirit and the scope of the invention.

What is claimed is:

1. A direction converting device for running a toy racer which comprises a base, a steering plate connected to wheels of the racer, a longitudinally extending controlling element having a longitudinal axis and engaged with said steering element and being swingably supported adjacent one of its ends on a shaft upwardly extending from said base, a pair of spaced apart magnets at a swingable opposite end of the controlling element, said magnets being symmetrically disposed on the controlling element on opposite sides of said longitudinal axis and having different polarities at their end faces, an electromagnet fixed to the racer base and comprising an iron core opposite to said magnets, said iron core being provided with at least one exciting coil positioned on said extension of said longitudinal axis of said controlling element in said neutral position of said controlling element, said exciting coil being energizable to different polarity for selectively swinging said controlling element leftward or rightward about said shaft, and neutral position retaining means operable on deenergizing said exciting coil for resiliently urging the controlling element through biasing means to its neutral position for running the toy racer in a straight direction, wherein the neutral position retaining means comprises a pair of engaging means pivoted at one end thereof to said base and symmetrically arranged relative to said shaft, and a stopper (38) supported on the controlling element along its longitudinal axis, said pair of engaging means resiliently holding therebetween said stopper.

2. A direction converting device according to claim 1, wherein said pair of engaging means comprises a pair of parallel supporting rods for contacting said stopper at an end opposite said pivoted one end of said engaging means, said supporting rods being resiliently urged toward each other through a spring to resiliently restore and retain the controlling element to the neutral position on deenergizing said electromagnet.

3. A direction converting device according to claim 1, wherein the iron core is E shaped, the opposed legs of the E-shaped core being adjacent to said magnets and symmetrically disposed relative to an extension of said longitudinal axis in a neutral position of said controlling element, the mid-leg of the E core carrying said at least one exciting coil.

* * * * *